United States Patent [19]

Sparkes

[11] Patent Number: 4,788,779

[45] Date of Patent: Dec. 6, 1988

[54] METHOD AND APPARATUS FOR THE RAPID CONSOLIDATION AND/OR DRYING OF MOIST POROUS WEBS

[75] Inventor: Donald G. Sparkes, Pointe Claire, Canada

[73] Assignee: Pulp and Paper Research Institute of Canada, Canada

[21] Appl. No.: 61,781

[22] Filed: Jun. 15, 1987

[51] Int. Cl.[4] ..... F26B 11/02

[52] U.S. Cl. ..... 34/117; 34/123

[58] Field of Search ..... 34/116, 117, 123, 124

[56] References Cited

U.S. PATENT DOCUMENTS

| | | | |
|---|---|---|---|
| 2,526,318 | 10/1950 | Battin | 34/116 |
| 3,110,612 | 11/1963 | Gottwald et al. | 34/116 |
| 3,286,360 | 11/1966 | Walker | 34/116 |
| 3,709,912 | 11/1972 | Greenberger | 219/10.61 |
| 3,974,026 | 8/1976 | Emson et al. | 34/123 X |
| 4,324,613 | 4/1962 | Wahren | 34/124 |
| 4,384,514 | 5/1963 | Larive et al. | 100/162 B X |

*Primary Examiner*—Steven E. Warner

*Attorney, Agent, or Firm*—Fetherstonhaugh & Co.

[57] ABSTRACT

There is taught a method and apparatus for a drying of a continuous moist web such as paper wherein the web is passed through a nip formed of two moving surfaces, one of these surfaces being a relatively impermeable material heated to a temperature of at least 120° C., the other surface being formed of a relatively porous material and being maintained at a temperature below 100° C., while maintaining a pressure on the moist web sufficient to prevent blowoff.

5 Claims, 1 Drawing Sheet

Figure 1:
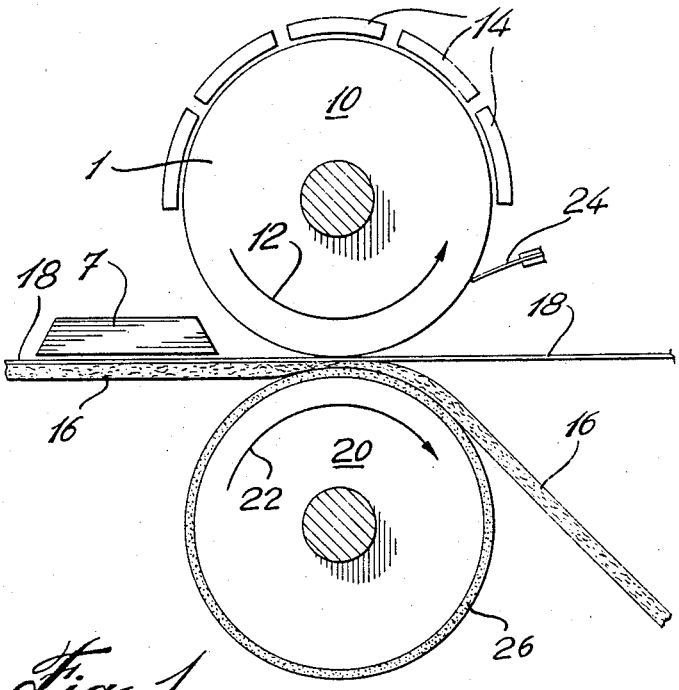

METHOD AND APPARATUS FOR THE RAPID CONSOLIDATION AND/OR DRYING OF MOIST POROUS WEBS

BACKGROUND OF THE INVENTION (i) Field of the Invention

The present invention relates to a method of rapid consolidation and drying of a continuous moist porous web and, more particularly, to a method of rapidly consolidating and drying a moist paper web.

(ii) Description of the Prior Art

Techniques presently employed in the paper industry tend to treat pressing and drying as two separate operations—mechanical removal of some water, together with consolidation of the web taking place in the presses, followed by heat application in the dryer section to remove the remaining water thermally to achieve the desired dryness.

In recent years, improvements in wet pressing have been achieved by utilizing improved clothing, i.e. press felts, multinip presses, increased dwell-time in the nip (e.g. the extended nip press) and by preheating the web (e.g. steam boxes, infra-red radiation). However, despite the improvements there are few commercial operations achieving a post-press dryness in excess of 50% solids. Drying is typically completed by passing the web over a series of rotating cast-iron cylinders which are heated internally with steam. Drying rates achieved by this method are low, necessitating a multiplicity of cylinders to achieve the required dryness of the web. Hence, a large capital investment is required initially and a high ongoing cost is incurred in maintaining the complete drying section in good working order (including syphons, steam traps, pumps, valves, fabrics, ventilation and heat recovery equipment etc.)

There have been proposals in the art, as exemplified by Wahren in U.S. Pat. No. 4,324,613, to greatly improve the rate and efficiency of drying a paper web, thus overcoming some of the disadvantages of the presently used methods. In this type of system, heat transfer to the pressing surface (in the above case a rotatable roll) is via a gaseous or liquid medium which is less than 100% efficient. In the case of a gaseous heat transfer medium, a heat recovery system has to be incorporated to reduce heat loss. In the case of a liquid heat transfer medium, a recirculating system has to be incorporated and, with it, attendant sealing problems. In both cases, the overall heating systems become more complicated and expensive. The alternative of heating by means of electric resistance elements embedded in the roll surface is also complicated because electric power must be fed through brushes or slip rings into the rotating roll.

In U.S. Pat. No. 3,702,912, Greenberger describes a method and apparatus for calendering strip-like material using induction heating to heat the roll surfaces through the material being processed. Larivé (U.S. Pat. No. 4,384,514 and Cdn patent No. 1,143,039) describes the use of multiple induction coils to control the nip profile of (for example) a calender by selective operation of coils to locally heat, and therefore increase the diameter of the roll. These patents do not address the high heat generation and transfer rates required for drying as taught herein.

However, heating a substantially ferromagnetic surface such as a roll by means of alternating current induction coils provides distinct advantages over the methods taught by Wahren in that:

1. The heat is generated within and very close to the surface of the roll and heating is therefore achieved more efficiently than heat transfer to the roll from hot gases or a liquid medium and 2. The induction coils may be simply mounted in close proximity to the roll surface and there is no need for the complicated and costly construction of heat recovery systems or the seals that would be necessary in the case of heating via a liquid medium, or of brushes or slip rings which would be required by roll-mounted electric resistance elements.

Generally, it has been accepted by the art that relatively high temperatures are desirable when utilizing drying technologies such as taught by Wahren. This can, however, in turn lead to problems with the material forming the porous surface and also with respect to the metallurgy of the heated surface.

SUMMARY OF THE INVENTION

It is an object of the invention to provide a method and apparatus for continuous drying of a moist paper web such as paper, which method is energy efficient and relatively inexpensive in terms of capital equipment required.

According to the present invention, there is provided a method and apparatus for the drying of a moist moving web such as a paper web which comprises a nip formed of first and second moving surfaces, the first moving surface being formed of a relatively hard impermeable material heated to a temperature in excess of 120° C., and preferably between 125° C. and 200° C., the second movable surface being formed of a relatively permeable material with the material being kept at a temperature below 100° C. The web is passed between the nip while under pressure to thereby remove the water at a relatively high thermal efficiency.

In greater detail, a moist web is passed between two cooperating surfaces forming a nip. One surface is capable of being heated to temperatures over 120° C. preferably by alternating current induction coils while the other surface is porous and maintained at a temperature lower than 100° C. The cooperating surfaces are pressed together so that the web is compressed as it passes through the nip.

It has surprisingly been found that the efficiency of the process is not necessarily dependent upon the temperature. Thus, one can practice the invention using temperatures between 120° C. and 200° C. and obtain the highest operating efficiency. This is contrary to the accepted belief that higher operating temperatures would provide better moisture removal.

Under these conditions very high rates of thermal energy flow from the heated surface to the web. Steam is generated at the interface between the hot surface and the web surface. Since the heated surface is substantially impermeable, the pressure gradient formed by the steam generation causes the steam to flow through the web and into the relatively cool porous surface on the opposite side of the web. Since the web is in a compressed state, water has already been squeezed out of the fibres into the interstices between the fibres. The flow of steam through the web tends to force the free water out of the web and into the porous surface. In this way, more water is removed from the web than would be removed by evaporation alone. Since the heat is generated within the heated roll, and very close to its operating surface, the conversion of electric power to heat and the transfer of heat into the web is highly efficient. In addition, the raising of the temperature of the paper web in the presence of moisture causes components of the fibres in the web to exceed their glass transition temperature and to yield under the pressure generated in the nip. In this way, fibres are brought into closer proximity and the consolidation or inter-fibre bonding is improved. Furthermore, the surface of the web in contact with the heated surface tends to acquire a mirror image of the heated surface. If the heated surface is essentially smooth, the web surface smoothness will improve.

The relatively impervious heated moving surface may, in one embodiment, comprise a suitable rotating roll. Such a roll can include a chrome-plated roll shell constructed from steel.

The relatively permeable porous moving surface may include a suitable cover for a rotating roll. Many such conventional machine felts are known in the art and may be constructed from materials such as nylon and/or polyester. In this respect, it is important to note that such materials are suitable in the practice of the present invention due to the temperature range employed; at higher temperature, more expensive materials are required to withstand higher roll temperatures.

Figure 2:
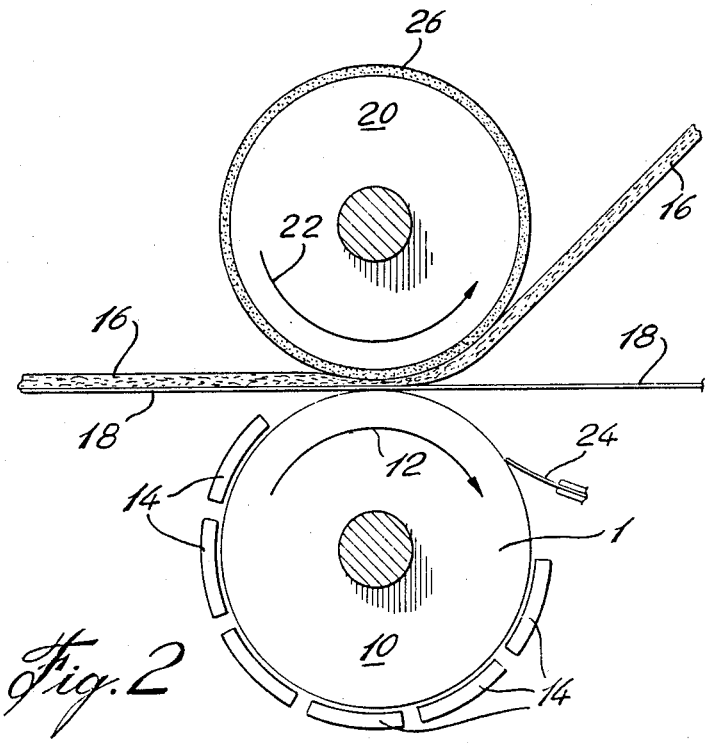

Having thus generally described the invention, reference will be made to the accompanying drawings illustrating an embodiment thereof, in which:

FIG. 1 is a schematic side elevational view showing the apparatus constructed according to the present invention; and FIG. 2 is a schematic side elevational view of a variation of the apparatus of FIG. 1.

Referring to the drawings in greater detail, FIG. 1 illustrates a simple embodiment of the invention. In this embodiment, there is provided first roll 10 which is driven by suitable means (not shown) to rotate in the direction indicated by arrow 12. Roll 10 is heated by suitable means and in the illustrated embodiment, is heated by A.C. electrical induction coils generally designated by reference numeral 14. One suitable arrangement would include coils spanning the operational width (that portion contacting the wet web) of the roll 10. The induction coils 14 are provided in numbers sufficient to provide the required heating capacity.

A second moveable surface comprises a conventional felt 16 as is widely employed in the paper making industry. Felt 16 supports a moist web 18 which is to be dried. Felt 16 is maintained at a temperature lower than 100° C. Supporting felt 16 is a backup roll 20 driven by suitable means (not shown) rotating in the direction indicated by arrow 22.

Conventional means (not shown) such as hydraulically operated cylinders may be provided for pressing the rolls together under suitable linear loads (typically 20–250 kN/m).

The illustrated embodiment illustrates the use of a doctor blade generally designated by reference numeral 24 which engages the surface of heated roll 10 to scrape any debris from the surface of the roll and keep it clean. Debris scraped off the roll by doctor blade 24 must be prevented from falling back onto the sheet by, for example, a vacuum slot (not shown) in close proximity to the working edge of doctor blade 24.

In operation, the web, deposited on the porous medium or felt, by direct forming, suction pick-up, pressing etc. is conveyed into the press nip formed between rolls 10 and 20 with the linear load between the rolls set to the desired value. The roll 10 is made of a metallic material of relatively high thermal conductivity and thermal capacity, and is preferably, but not essentially, substantially ferromagnetic. The surface of the roll must be such that it will not cause the web to adhere to the roll after pressing. In practice, it has been found that satisfactory performance can be achieved by chrome plating a roll shell constructed from steel, but other constructions might be employed.

On entering the nip, the web is subjected to pressure. This pressure compresses the web to the extent that air is expressed and the web at this point is composed substantially of fibres and mainly "free" water. At the same time, the top surface of the web and its associated water is brought into intimate contact with the heated surface of the roll. This intimate contact results in a very high rate of heat transfer, and the generation of steam under pressure. Due to the pressure gradient thus created between the hot roll and the cool roll, the steam migrates through the web and into the felt. In passing through the pores of the sheet it tends to flush out the "free" water residing in the pores.

As the speed of operation increases, the dwell-time of the web in the nip will decrease. This can be offset, to some extent, by preheating the web as illustrated by numeral 7 in FIG. 1, immediately before its entry into the nip by, for example, the use of steam or infra-red energy which is commonly referred to as "hot-pressing". This will reduce the required dwell-time in the nip by the time otherwise required for heating up the web surface and its associated water. The effective nip width can also be increased by fitting the cool roll 20 with a cover 26 which is deformed in the nip. For example, a rubber cover 10–50 mm thick and of a P&J hardness in the range 10 to 30 could be fitted to a large diameter roll (~1.5 meters) as is known in the art of high intensity long-nip pressing. Even longer dwell times could be achieved by replacing the roll 2 with a belt and shoe arrangement of the type known as an "extended nip" press.

The porosity of the sheet or web is of importance in the practice of the invention. It was found that when dwell-times were shorter, low porosity webs tended to have a problem with sheet splitting. In order to overcome this, an extended dwell-time may be desirable particularly for low porosity webs.

FIG. 1 shows the electric induction heating of the roll 10 as being achieved by multiple rows of electrical induction coils spanning the width of the paper machine. However, it is quite feasible that the required heating could be supplied by a single coil of sufficient capacity spanning the width of the paper machine. Very large capacity units are already known, for example, in the melting of metals in electrical induction furnaces. While it is possible to heat the roll with alternating current in the coil(s) at mains frequency 60 Hz, it is well known that the depth to which heat is generated is a function of the frequency of the exciting current. Since the present requirement is for heat to be generated at the surface of the roll it is preferable to employ a frequency of 1 kHz or above.

Direct current induction heating is also known as a means of heating rolls, whereby heat is generated from eddy currents induced when a ferromagnetic material moves through the magnetic field of stationary electromagnets. This technique requires additional motive power to drive the roll in order to induce the current which heats the roll, and this puts additional loads on the roll bearings. By using A.C. induction heating we avoid this problem.

On exiting the nip, it is advisable to part the web 18 from the felt 16 in order to minimize rewetting of the web with the water now in the felt. The felt is conditioned and dewatered on its return run by means already well known in the art of pressing, such as water sprays and vacuum extraction.

In FIG. 2, the positions of the heated and cool rolls has been reversed. With this configuration the opposite side of the web contacts the heated roll. It has been found in practice that the surface of the web in contact with the heated roll becomes smoother during processing in the nip. Since it is desirable that the end product (e.g. newsprint) should have surfaces with as nearly equal properties as possible, it is envisaged that the ideal situation would be to have two units operating in tandem and treating opposite sides of the web. That is, a unit as in FIG. 1 immediately followed by a unit as in FIG. 2, or vice-versa.

Table 1 illustrates the effects of roll temperature and nip load on water removal rate for a 30 cm wide web at an initial solids content of 42% (1.4 moisture ratio) processed at a speed of 50 m/min in the apparatus shown in FIG. 1. The 50 g/m$^2$ web was made from a reslushed newsprint furnish.

TABLE I

| Roll Temp. °C. | Water Removal Rate (g/s) at 20 kN/m | at 47 kN/m | at 77 kN/m | at 106 kN/m |
|---|---|---|---|---|
| Ambient | 1.5 | 2.6 | 2.9 | 3.7 |
| 150 | 9.0 | 10.2 | 11.0 | 12.0 |
| 200 | 10.3 | 11.9 | 12.2 | 12.3 |

From Table I it is clear that the effect of temperature is dependent on the nip load employed. At 106 kN/m there appears to be little advantage in raising the roll temperature from 150° C. to 200° C. The small effect of roll temperature in the range 150° C. to 200° C. has been confirmed at higher roll speeds as shown in Table II.

TABLE II

| Speed m/min | Roll Temperature °C. | Water Removal Rate (g/sec) at 106 kN/m |
|---|---|---|
| 100 | Ambient | 9.7 |
| | 150 | 23.5 |
| | 180 | 24.3 |
| | 200 | 23.7 |
| 200 | Ambient | 19.3 |
| | 150 | 42.5 |
| | 180 | 43.9 |
| | 200 | 40.7 |

Table III shows examples of web solids contents and water removal obtained by electric induction heating with a range of roll temperatures from 150° C. to 200° C. at a nip load of 106 kN/m.

TABLE III

| Speed m/min | Roll Temperature °C. | Web Solids In % | Web Solids Out % | Water Removed % |
|---|---|---|---|---|
| 100 | 150 | 39.4 | 59.8 | 56.3 |
| 100 | 180 | 39.4 | 61.1 | 58.6 |
| 100 | 200 | 39.7 | 60.5 | 57.0 |
| 200 | 150 | 36.7 | 51.6 | 45.6 |
| 200 | 180 | 36.6 | 52.3 | 47.3 |

TABLE III-continued

| Speed m/min | Roll Temperature °C. | Web Solids In % | Web Solids Out % | Water Removed % |
|---|---|---|---|---|
| 200 | 200 | 37.6 | 51.9 | 44.2 |

Clearly, the exiting solids content of the web and the amount of water removed is very dependent on the speed of processing (i.e. dwell time in the nip), but relatively insensitive to the temperature of the heated roll in the range examined. For example exiting solids contents over 70% have been obtained in our experimental trials at lower speeds.

TABLE IV

| Speed m/min | Roll Temperature °C. | Web Solids In % | Web Solids Out % | Power Savings % |
|---|---|---|---|---|
| 100 | Ambient | 39.2 | 45.6 | — |
| 100 | 150 | 39.4 | 59.8 | 29.2 |
| 100 | 180 | 39.4 | 61.1 | 36.7 |
| 100 | 200 | 39.7 | 60.5 | 31.5 |
| 200 | Ambient | 36.7 | 44.7 | — |
| 200 | 150 | 36.7 | 51.6 | 42.1 |
| 200 | 180 | 36.6 | 52.3 | 35.6 |
| 200 | 200 | 37.6 | 51.9 | 31.3 |

Thus, even from the point of view of the efficiency of power utilization, as shown in Table IV there is no obvious advantage to be gained from operation at the high end of the temperature range examined when utilizing relatively high nip loads and short nip residence times.

In a separate series of experiments, the roll temperature was taken up to 250° C. The results obtained at a nip load of 106 kN/m are shown in Table V.

These power savings are calculated by comparing the typical power requirements for conventional drying of paper with those actually used in these tests.

TABLE V

| Speed m/min | Roll Temperature °C. | Web Solids In % | Web Solids Out % | Power Savings % |
|---|---|---|---|---|
| 100 | Ambient | 40.3 | 47.3 | — |
| 100 | 150 | 40.1 | 58.7 | 13.6 |
| 100 | 200 | 40.2 | 55.2 | (11.7) |
| 100 | 250 | 40.1 | 57.1 | (21.9) |

A change in reslushed newsprint furnish and a higher ingoing solids content has resulted in a higher exiting solids at ambient temperature, and a lower exiting solids at elevated temperatures than the corresponding figures in Table IV. Nevertheless, it is clear that raising the roll surface temperature to 250° C. has not improved water removal or energy efficiency when compared to treatment at 150° C.

The relative insensitivity of water removal rate to roll surface temperature in the range examined means that control of roll surface temperature profiles within close limits is not necessary. In addition, the demands placed upon the felt in terms of heat resistance may be lessened by operating at the lower end of the temperature range examined.

Furthermore, we have shown that there is no loss of thermal efficiency associated with operation under these conditions.

It will be understood that the above described embodiments are for the purposes of illustrations. Other changes and modifications may be made thereto without departing from the spirit and scope of the invention.

I claim:

1. A method for the drying of a moist, porous moving web comprising the steps of forming a nip between first and second moving surfaces, the first moving surface comprising a rotating cylinder formed of a relatively hard impermeable material, the second moving surface comprising a moving permeable felt supporting the moist moving web on a second rotating cylinder, maintaining a pressure at said nip, passing the moist moving web between the first and second moving surfaces, heating said first moving surface before the nip to a temperature in excess of 120° C. by induction heating using alternating current induction coils at a frequency of at least one kilohertz, and maintaining the second moving surface at a temperature below 100° C.

2. The method of claim 1 wherein the step of heating said first movable surface comprises the step of heating the surface to a temperature of between 120° C. to 200° C.

3. The method of claim 1 wherein said moist, porous, moving web is a paper web.

4. The method of claim 2 wherein the step of maintaining a pressure at said nip comprises the step of pressing said cylinders together at a pressure of between 20 kN/m to 250 kN/m.

5. An apparatus suitable for the drying of a continuous moist web of paper, comprising first and second moving surfaces, a nip formed between said first and second moving surfaces, the first moving surface comprising a rotating cylinder formed of a relatively hard impermeable material, the second moving surface comprising a moving permeable felt supporting the moist web of paper on a second rotating cylinder, means for maintaining pressure at said nip, induction heating means for heating said first moving surface before the nip to a temperature of at least 120° C. using alternating current induction coils at a frequency of at least one kilohertz, and means for maintaining said second moving surface at a temperature below 100° C.

* * * * *